US007156190B2

(12) United States Patent
Ottestad et al.

(10) Patent No.: US 7,156,190 B2
(45) Date of Patent: Jan. 2, 2007

(54) IMPACT TOOL

(75) Inventors: Jack B. Ottestad, Genoa, NV (US); Craig A. Berard, Bismarck, ND (US)

(73) Assignee: Clark Equipment Company, Woodcliff, NJ (US)

( * ) Notice: Subject to any disclaimer, the term of this patent is extended or adjusted under 35 U.S.C. 154(b) by 125 days.

(21) Appl. No.: 11/014,466

(22) Filed: Dec. 16, 2004

(65) Prior Publication Data

US 2005/0145400 A1 Jul. 7, 2005

Related U.S. Application Data

(60) Provisional application No. 60/531,448, filed on Dec. 19, 2003.

(51) Int. Cl.
*B23B 45/16* (2006.01)

(52) U.S. Cl. ..... 173/208; 173/135; 173/138; 173/200; 173/128

(58) Field of Classification Search ..... 173/208, 173/135, 138, 200, 128, 212; 91/165
See application file for complete search history.

(56) References Cited

U.S. PATENT DOCUMENTS

| | | | | |
|---|---|---|---|---|
| 1,629,117 | A * | 5/1927 | Penberthy | 91/231 |
| 3,191,694 | A * | 6/1965 | Elliott et al. | 173/101 |
| 3,363,512 | A | 1/1968 | Ottestad | 91/5 |
| 3,363,513 | A | 1/1968 | Ottestad | 91/5 |
| 3,512,454 | A | 5/1970 | Perkins | 91/461 |
| 3,524,385 | A | 8/1970 | Ottestad | 91/224 |
| 3,609,969 | A * | 10/1971 | Gerber | 60/371 |
| 3,695,366 | A | 10/1972 | Klessig | 173/134 |
| 3,735,823 | A | 5/1973 | Terada | 173/119 |
| 3,822,633 | A | 7/1974 | Ottestad | 91/224 |
| 3,866,690 | A | 2/1975 | Lance et al. | 173/15 |
| 3,903,972 | A | 9/1975 | Bouyoucos et al. | 173/134 |
| 3,924,513 | A | 12/1975 | Ottestad | 91/224 |
| 3,925,985 | A | 12/1975 | Peterson | 60/371 |
| 3,948,051 | A | 4/1976 | Marshall | 60/542 |

(Continued)

FOREIGN PATENT DOCUMENTS

| | | |
|---|---|---|
| EP | 0 426 928 | 5/1991 |

(Continued)

OTHER PUBLICATIONS

Copy of International Search Report.

(Continued)

*Primary Examiner*—Scott A. Smith
*Assistant Examiner*—Brian Nash
(74) *Attorney, Agent, or Firm*—Westman, Champlin & Kelly, P.A.

(57) ABSTRACT

An impact tool has a slidable hammer that is driven by hydraulic oil under pressure inside a chamber. The hydraulic oil is pressurized by a piston driven by compressed gas on the opposite side of the piston from the hydraulic oil. The gas in the gas chamber is compressed by the piston on an initial stroke, and has a large annular chamber holding the gas so that higher average gas pressure can be attained during the power stroke. As the piston is moved to compress the gas, the piston lifts a valve that opens a passage for the hydraulic oil moved by the piston to act on a hammer to impact a breaking tool. The piston is a two part piston that serves to lower the inertia during the final closing of the valve, and thereby reduces impact loads on the valve as it is closed. The valve also is controlled as to its stroke for efficient operation.

17 Claims, 13 Drawing Sheets

U.S. PATENT DOCUMENTS

| | | | | | |
|---|---|---|---|---|---|
| 4,005,637 | A | | 2/1977 | Bouyoucos et al. | 91/276 |
| 4,073,218 | A | | 2/1978 | Pollinger | 92/85 R |
| 4,077,304 | A | | 3/1978 | Bouyoucos | 91/276 |
| 4,089,380 | A | * | 5/1978 | Hibbard | 173/133 |
| 4,111,269 | A | | 9/1978 | Ottestad | 173/134 |
| 4,159,853 | A | | 7/1979 | Oberthuer et al. | 303/6 C |
| 4,181,183 | A | | 1/1980 | Okada | 173/119 |
| 4,211,150 | A | | 7/1980 | Framberg | 92/119 |
| 4,231,434 | A | | 11/1980 | Justus | 173/119 |
| 4,264,107 | A | | 4/1981 | Janach et al. | 299/69 |
| 4,295,411 | A | | 10/1981 | Grantmyre et al. | 91/165 |
| 4,479,551 | A | | 10/1984 | Justus | 173/119 |
| 4,505,340 | A | * | 3/1985 | Yantsen et al. | 173/208 |
| 4,550,784 | A | | 11/1985 | Ottestad | 173/114 |
| 4,676,323 | A | * | 6/1987 | Henriksson | 173/200 |
| 4,784,228 | A | * | 11/1988 | Ito | 173/208 |
| 4,817,737 | A | | 4/1989 | Hamada et al. | 173/115 |
| 4,951,757 | A | | 8/1990 | Hamada et al. | 173/115 |
| 5,052,498 | A | | 10/1991 | Gustafsson et al. | 173/118 |
| 5,056,606 | A | * | 10/1991 | Barthomeuf | 173/13 |
| 5,065,824 | A | | 11/1991 | Ottestad | 173/134 |
| 5,269,382 | A | | 12/1993 | Ottestad | 173/200 |
| 5,279,120 | A | * | 1/1994 | Sasaki | 60/413 |
| 5,392,865 | A | | 2/1995 | Piras | 173/17 |
| 5,893,419 | A | | 4/1999 | Hodges | 173/13 |
| 5,944,120 | A | | 8/1999 | Barden | 173/212 |
| 5,947,211 | A | | 9/1999 | Jakobsson | 173/210 |
| 6,073,706 | A | * | 6/2000 | Niemi | 173/206 |
| 6,155,353 | A | | 12/2000 | Ottestad | 173/128 |

FOREIGN PATENT DOCUMENTS

| | | |
|---|---|---|
| WO | WO 00/78510 | 12/2000 |

OTHER PUBLICATIONS

Copy of Written Opinion.

* cited by examiner

IMPACT TOOL

The application refers to and claims benefit of priority from U.S. Provisional Patent Application Ser. No. 60/531,448, filed Dec. 19, 2003, the contents of which are incorporated by reference.

BACKGROUND OF THE INVENTION

The present invention relates to an impact tool that has a valving arrangement utilizing a sleeve valve that has a controlled displacement during valving operations, and which opens ports to a hammer head to drive the hammer under hydraulic fluid pressure. Pressurized hydraulic fluid is provided by a sliding stepped piston that slides along the valve to initially compress a gas and which piston is then driven by compressed gas to force hydraulic fluid under high pressure against the hammer. The valve mates with a seat and is configured to cushion the engagement of the valve and seat as the valve reaches the end of its stroke. An accumulator is preferably provided for modulating pressure spikes generated by hammer rebound after an impact stroke.

Impact tools are known, as shown in U.S. Pat. No. 6,155,353, issued to one of the present inventors. The '353 patent illustrates a hammer slidably mounted in an outer body and a sliding valve of the general type shown in this specification. The '353 patent includes a piston that compresses a gas that in turn will, when valved, drive the piston to force hydraulic oil under high pressure against the hammer. The hammer then strikes a striking or breaking tool that is used for breaking hard materials such as concrete, asphalt and the like.

The existing hydraulic powered impact tools generally provide hammer impacts on the breaking tool in rapid repetition of short bursts of high energy, and the impact tool oscillates during operation with a high frequency. Various valving arrangements have been advanced, with a goal toward greater energy efficiency. Maximum utilization of input energy for providing output forces of the hammer is desired, and obtaining higher impact forces on the impact tool also is a desired goal.

SUMMARY OF THE INVENTION

The present invention relates to an impact tool that has a body slidably mounting a hammer, which reciprocates in a chamber in the body. The hammer is operated by a piston that is forced by compressed gas to drive hydraulic oil against the hammer under control of a sleeve valve that alternately causes the piston to compress the gas and release the hydraulic oil.

The hammer is associated with an external hydraulic source that moves an end of the hammer against a first side of an orifice ring, and the separate tubular sleeve valve seals on the second opposite side of the orifice ring. The hydraulic fluid under pressure from the external source acts in a piston chamber on a base side of a slidable piston mounted in the housing to move the piston along a closed gas chamber at the top of piston when the sleeve valve seals on the orifice. The sleeve valve also controls a drain passageway that is open when the valve seals in the orifice and closed when the valve opens the orifice. The piston is also on the second side of the orifice ring, and the movement of the piston on a compression stroke in a direction away from the orifice ring compresses the gas in the chamber to a high level.

After the piston has moved a selected amount on its compression stroke, a portion of the piston engages a valve actuator or drive member on the tubular sleeve valve, which is slidably mounted in an internal bore of the piston and extends through the piston. Further movement of the piston in direction away from the orifice ring moves the tubular valve away from the second side of the orifice ring to open the orifice and close the drain passageway from the interior of the tubular valve. The hydraulic oil in the piston chamber is then directed through the opening of the orifice ring to drive the hammer toward the impact tool.

The hydraulic fluid that moved the piston on its compression stroke flows through the now open orifice and drives the hammer as the piston reverses in direction due to the high gas pressure in a top piston chamber. The gas pressure is raised to a high level by the compression stroke of the piston. The reverse movement of the piston through the base side piston chamber, toward the orifice ring accelerates the hydraulic oil in the base side piston chamber and forces the hammer to accelerate away from the orifice ring on an impact stroke. The base end of piston engages a second stop or shoulder on the tubular sleeve valve and forces the sleeve valve toward the orifice ring to seal the orifice opening after the hammer has been driven in an impact stroke, and the drain passage from the interior of the tubular sleeve valve is then again opened. The hammer is driven back toward the orifice ring by hydraulic pressure and the hydraulic oil that drove the hammer flows to drain while the hammer returns seat on the orifice ring. The tubular sleeve valve seats and seals on the side of the orifice ring opposite from the hammer to again cause the fluid pressure from the external source to drive the piston on its compression stroke.

The accelerated flow of hydraulic oil through the orifice resulting from the high pressure gas on the piston slams the hammer down against the breaking tool, and the tool moves through a fixed stroke against a surface to be impacted or broken.

The second stop on the tubular sleeve valve is a ring forming a shoulder on the end of the tubular sleeve valve adjacent the orifice ring. The end of the piston engages the shoulder as the piston moves on its drive stroke. The side of the ring on the valve opposite the shoulder seals on the orifice. The opposite end of the sleeve valve closes and opens the drain port or passageway. The movement of the sleeve valve toward the orifice ring opens the interior passageway of the tubular valve to the drain port, and this permits the hydraulic fluid (oil) that drove the hammer on its impact stroke to pass through the orifice ring through the center of the tubular valve, and out through the drain.

The tubular sleeve valve is positively stopped in both of its closing positions, that is, closing the orifice, and closing the drain. Also, the valve and the valve seats are designed to provide for a slowed, cushioned hydraulic oil bleed as the valve approaches both ends of its movement to avoid high-speed impact with the orifice seal and drain valve surfaces which may damage to the tubular valve.

The piston is a stepped piston, and has a larger surface area on the top side open to the gas chamber. The surface area at the piston base on which the hydraulic fluid under pressure acts to move the piston and compress the gas is smaller. This provides for greater energy input on the hammer from the drive stroke of the piston for driving the hammer.

Additionally, the piston, which surrounds the tubular valve, is made of two parts, so that on its hammer drive stroke (toward the orifice ring), when driven by the gas under pressure, one portion of the piston is stopped on a shoulder on the piston sleeve while a smaller piston section seats the valve on the second side of the orifice ring seal with a lower inertial force than the inertial force of the entire piston to acting on the valve.

The drain passageways are open to an accumulator which will absorb pressure spikes caused by the hammer when it bounces after the impact with the striking tool onto a hard object.

The housing or body of the tool provides an annular gas filled chamber surrounding the piston sleeve in which the piston moves to permit increasing the volume of the gas that is compressed by the piston and used for driving the piston to actuate the hammer, without increasing the length of the housing.

DETAILED DESCRIPTION OF THE PREFERRED EMBODIMENTS

Figure 1A:
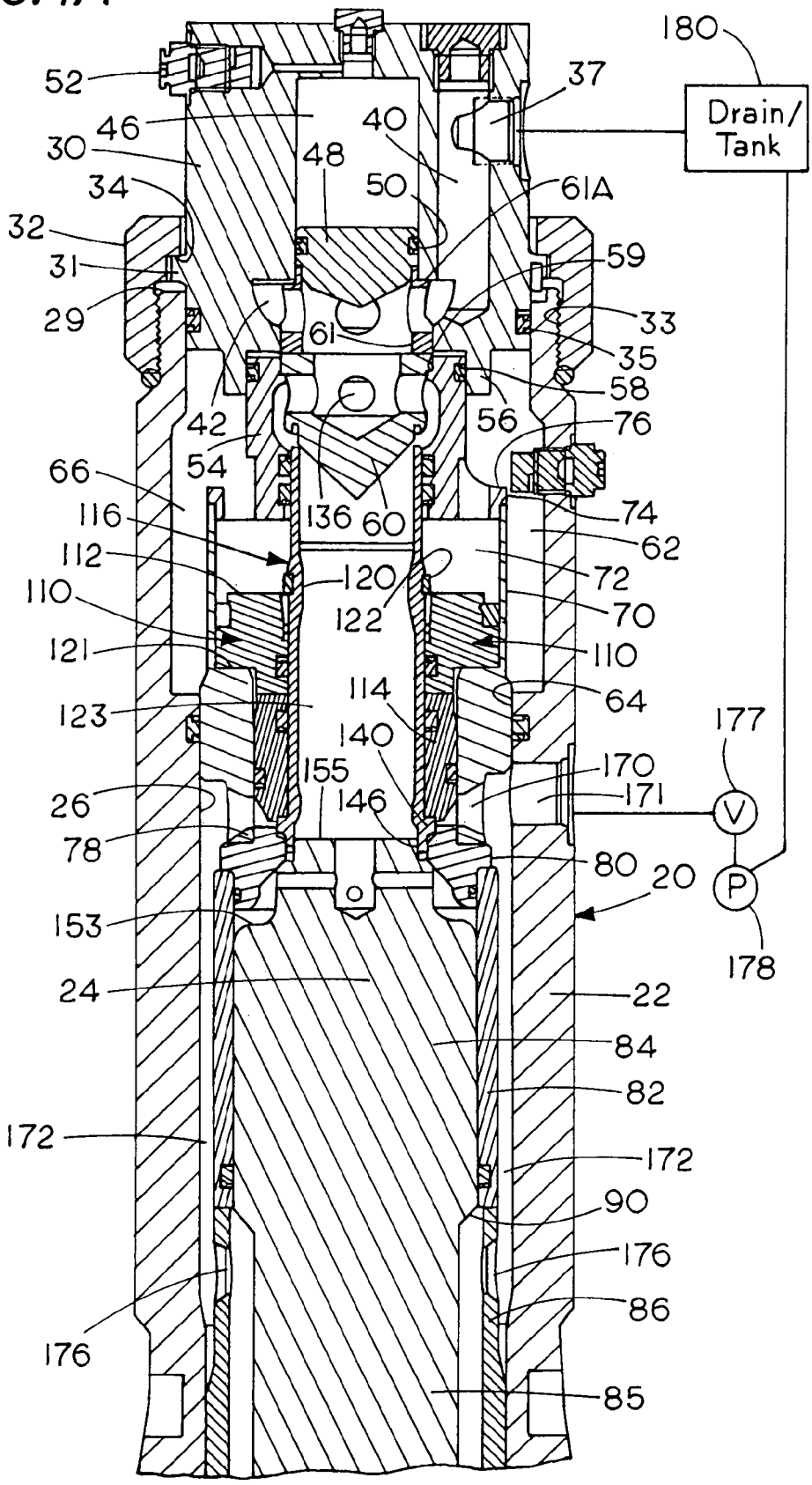
FIGS. 1A and 1B are together an axial cross section of one preferred embodiment of the impact tool of the present invention with tool components in the present arrangement shown at a "start" of a cycle.
Figure 1B:
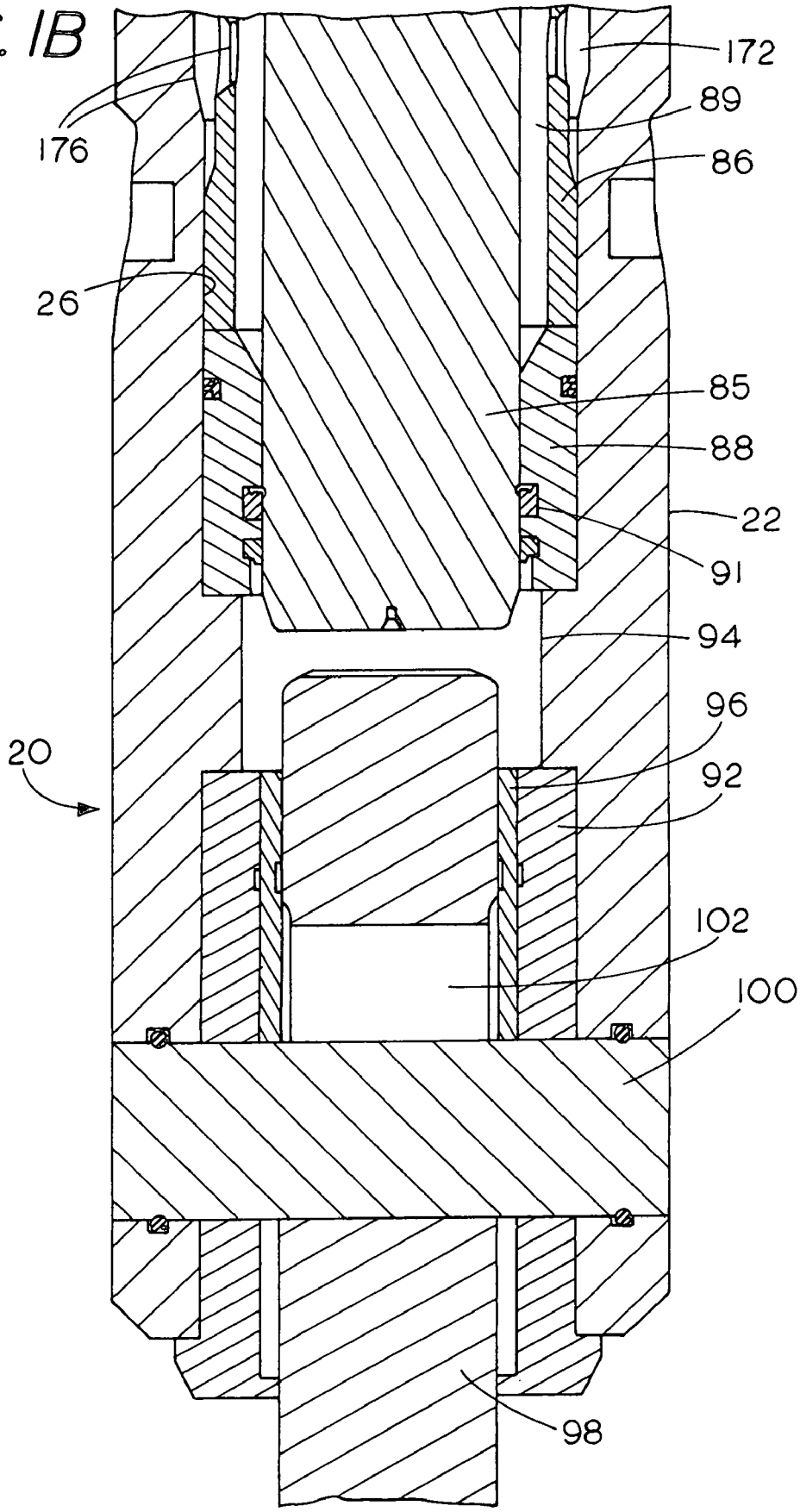

The embodiment in FIGS. 1A and 1B show an impact tool 20 which includes a body 22 that has a longitudinal central axis 24, which is the axis of operation and along which a hammer will deliver the blow for the impact tool. A longitudinal passageway 26 is defined in the body, and has various diameters, particularly in relation to the upper end shown in FIG. 1A. The body 22 has an upper end cap 30, which in this invention forms an accumulator chamber as will be described.

The end cap 30 includes a peripheral ring shoulder 31 that is integral with the end cap, and which is adjacent an end surface 29 of the body 22. An end cap nut 32 is provided and is threaded onto the body 22 with threads 33. The end cap nut has a flange forming a shoulder 34 that bears against the shoulder 31 of the end cap 30. A seal 35 is used for sealing the end cap 30, which again will form a accumulator chamber 46 that will serve to cushion pressure spikes during operations.

The end cap 30 is used to provide an axial load to retain various internal components properly positioned in the passageway 26, as shown in the drawings. The upper internal components 61, 60, 54, and 70 are in series loading and bear against an orifice ring 80, which in turn bears against stacked internal sleeve components 82, 86 and 88 held on the shoulder formed by a ring 94 on the interior of the housing 22 adjacent its lower end.

A drain port 37 passes through the side of the end cap 30, and drain passageway 40 is provided in the end cap leading down to an annular chamber 42 in the end cap. The end cap interior bore 46 is the accumulator chamber and contains a charge of gas under pressure for resisting movement of an accumulator piston 48 that sealingly slides in the bore 46.

The accumulator piston 48 has a seal 50 around its periphery, and it will slide along the bore 46 in response to differential pressures between its upper end and its lower end. The pressure in chamber 46 is provided by filling a suitable gas under pressure through a plugged opening 52, and in the position shown in FIGS. 3 and 4, the accumulator piston 48 is at its lower-most end position.

End cap 30 centers the valve guide sleeve 54 in a recess formed by an annular neck collar 56. Valve guide sleeve 54 is also sealed with a seal 58. The valve guide sleeve 54, in turn, has an annular shoulder 59 that is engaged by a shoulder for drain valve body 60, which is a plug in the end of the valve guide sleeve. As will be explained, plug or drain valve body 60 is held by cap 30 stationary relative to the tool body 22. Drain valve body 60 serves as a valve body for opening and closing drain passageways that connect to the port 37 through annular passageway 42.

Tool body 22 has an annular chamber 62 that extends from the base or inner end of the end cap 30, by collar 56, downwardly to a reduced bore section 64 which is of size to center the lower end of a cylindrical piston guide sleeve 66. The piston guide sleeve 66, as shown, has an internal bore section at a first smaller diameter to form a piston chamber 68, and a larger diameter upper piston guide sleeve section 70 that forms a larger sized piston chamber 72. The piston sleeve 66 has an upper end 74 which bears against a lower shoulder or flange 76 of the upper valve guide sleeve 54. Thus, the cap 30 applied axial load on the top of the piston sleeve 66.

The lower end of the piston sleeve 66 also has a reduced end portion 78 that has an end surface engaging an orifice ring 80.

The orifice ring 80 is supported on an upper end of a cylindrical sleeve 82 that is a sleeve bearing used for slidably mounting the solid hammer 84. The hammer 84 reciprocates in the sleeve bearing 82. The sleeve bearing 82 is, in turn, held in position supporting the orifice ring 80 on its upper end with a cylindrical sleeve spacer 86. The spacer 86 supports the lower end of sleeve bearing 82 and in turn, is supported on a lower end bearing 88 that is used for mounting the lower and smaller diameter end portion 85 of the hammer 84.

It can be seen that the spacer 86 is spaced inwardly from the inner surface of the central bore of body 22 to form an annular passageway or chamber 172, and is spaced outwardly from the smaller diameter end portion 85 of the hammer 84. This space forms an annular chamber 89 between the hammer portion 85 and spacer 86. The smaller diameter hammer portion forms a shoulder 90 on the hammer. The passage 89 provides a chamber for hydraulic fluid under pressure to act on the shoulder 90 of the hammer 84, to provide force to urge the hammer 84 toward orifice ring 80 when hydraulic pressure is present in chamber 89.

The lower sleeve bearing 88 is sealed with seals 91 to seal chamber 89, and is held in place with a cylindrical tool holder sleeve 92 (FIG. 1B). This tool holder sleeve 92 is in the bore of housing 22 and is pinned to the outer housing 22 in a suitable manner with pins 100 shown schematically, so that it is anchored axially in place relative to the housing 22. The housing 22 provides a reaction surface for the stacked components, compression bearing 88, spacer 86, sleeve bearing 82, orifice 80, piston sleeve 66, valve guide sleeve 54, and plug 60, that were just described which these components are held under compression with the cap 30 and cap nut 32.

The tool holder 92, has an internal tool bearing 96 which is a sleeve that slidably mounts the breaker or striking tool 98. The striking tool 98 is guided for axial sliding movement with a cross pin 100. The pin 100 is fixed to housing 22 and extends across the housing. The pin 100 extends through a slot 102 in the striking tool 98, to let the striking tool reciprocally move axially a limited distance. This limited distance of movement is permitted by the slot 102 and pin 100 when the tool is hit by the hammer head and any forces on housing 22 cause the striking tool 98 to move upwardly along the pin 100.

The sleeve bearing 96, striking tool 98 and pin 100 are inserted in locking holder 92, the bearing 96 and striking tool 98 in housing 22.

Figure 2:
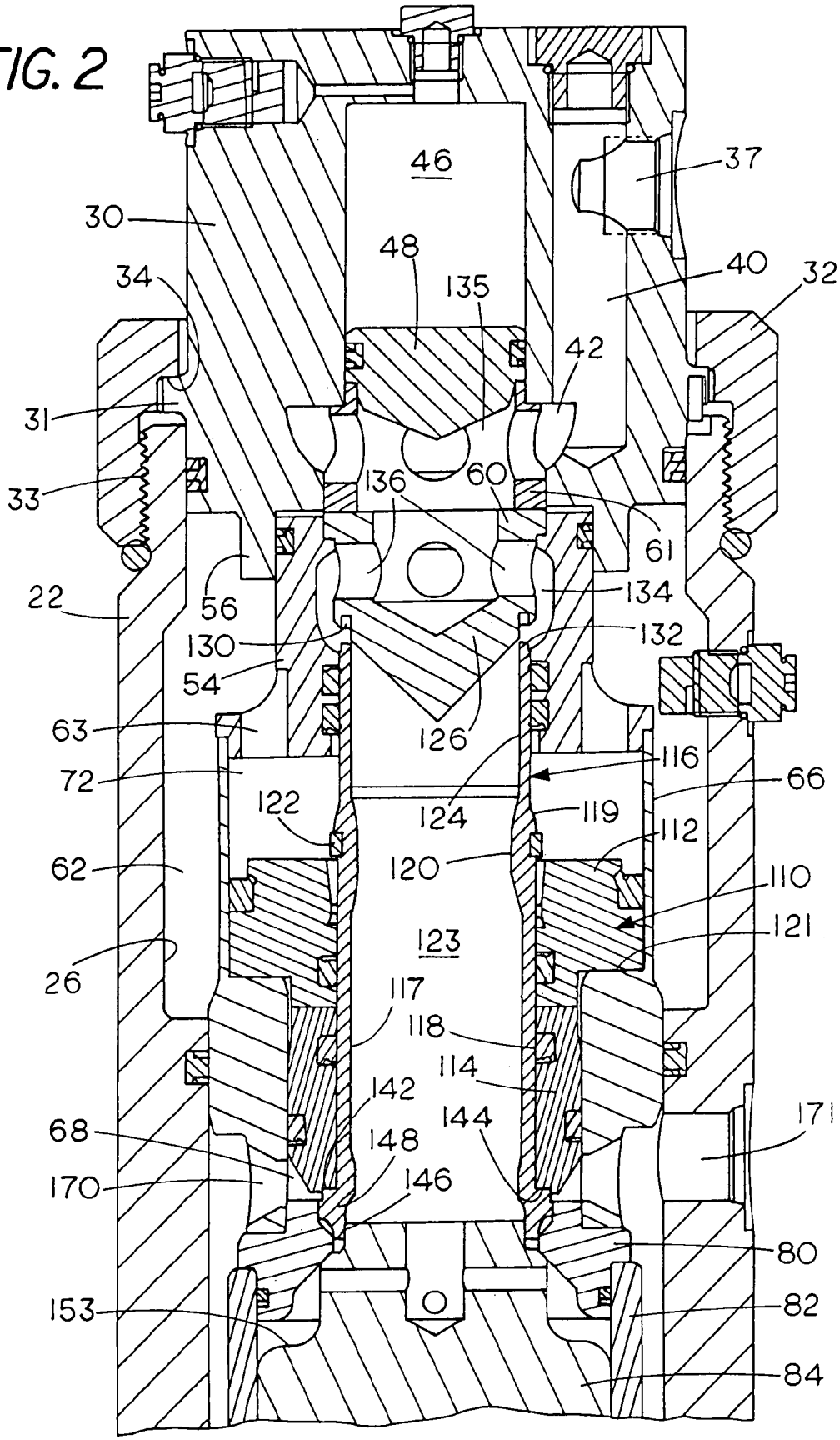
FIG. 2 is an enlarged cross sectional view showing the operating valve and energy piston arrangement at an upper end of the impact tool.

In larger scale in FIG. 2, it can be seen that the piston sleeve 66 surrounds and supports a two part piston 110 mounted in the two different diameter bore thereof. Piston 110 includes a large diameter annular first piston portion 112, mounted in the first piston chamber 72 and a separate smaller diameter annular piston portion 114 in the second piston chamber 68. These piston portions are both annular rings or "donuts" and have central bores in which a tubular sleeve valve 116 is mounted for relative axial sliding movement. The sleeve valve 116 is an elongated, open bore or center sleeve that has a lower portion 117 that fits into the bores of piston portions 112 and 116 and a smaller outer diameter, upper portion 124 that extends into the bore of the valve guide 54. The transition between lower portion 117 and smaller diameter upper portion 123 forms a shoulder 119 that acts as a piston reaction surface. As can be seen, various suitable seals 118 as needed are used for sealing the sleeve valve 116 relative to the bores in which it slides in guide 54 and in piston 110.

The interior bore 123 of the sleeve valve 116 is also configured to have different internal diameters at desired locations along its axis. In the mid-portion 120 of the sleeve valve 116, there is an external snap ring 122 mounted in an annular groove on the outside of the sleeve valve and the sleeve valve wall is thicker there. The upper portion 124 of the sleeve valve 116 that slides into the valve guide 54 has a thinner wall and the bore 123 in the portion 124 is of size to fit around a plug end 126 of the plug or drain valve 60 as shown.

Figure 7:
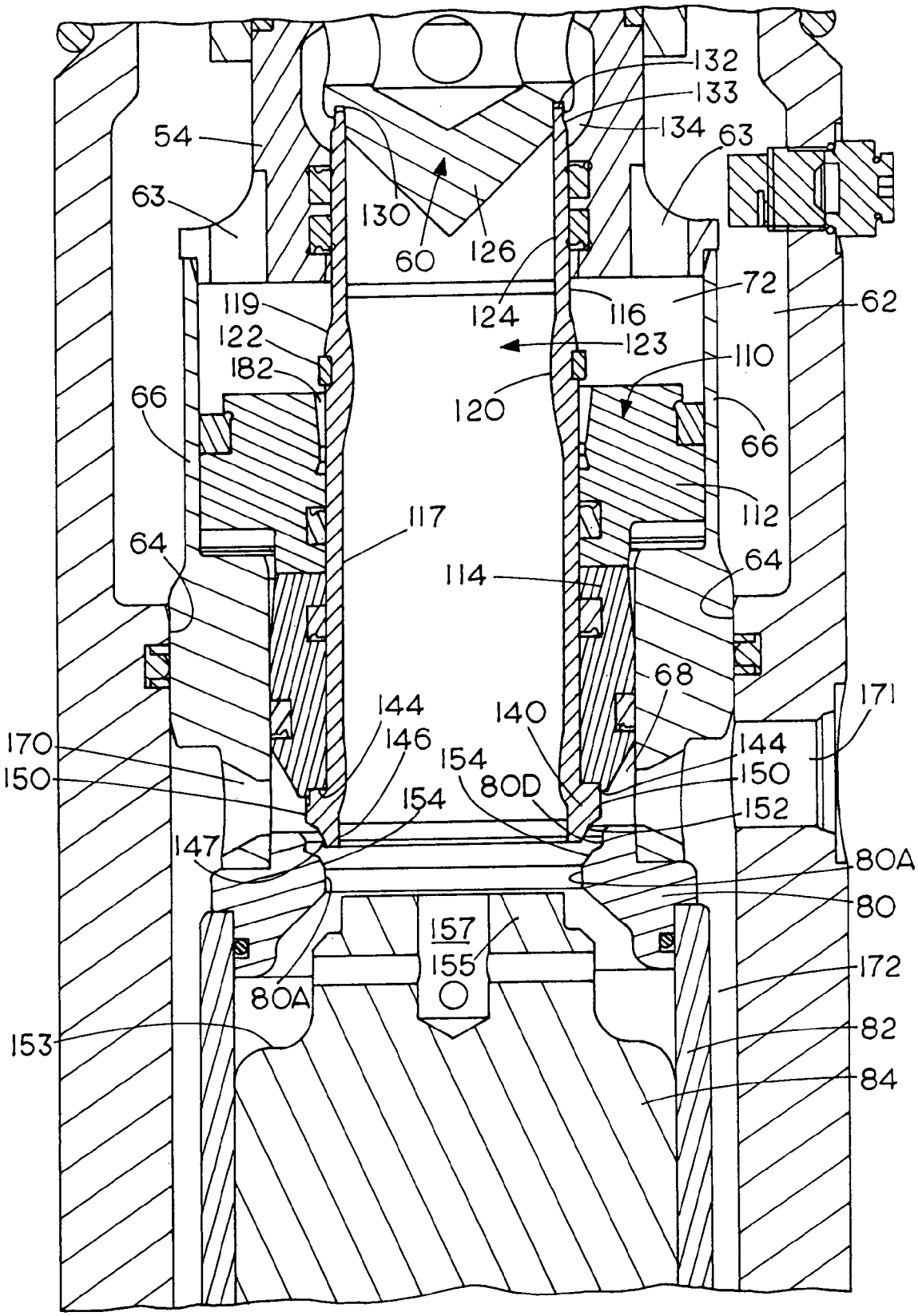
FIG. 7 is a further enlarged sectional view of the valve as it approaches the position of FIG. 6.
Figure 8:
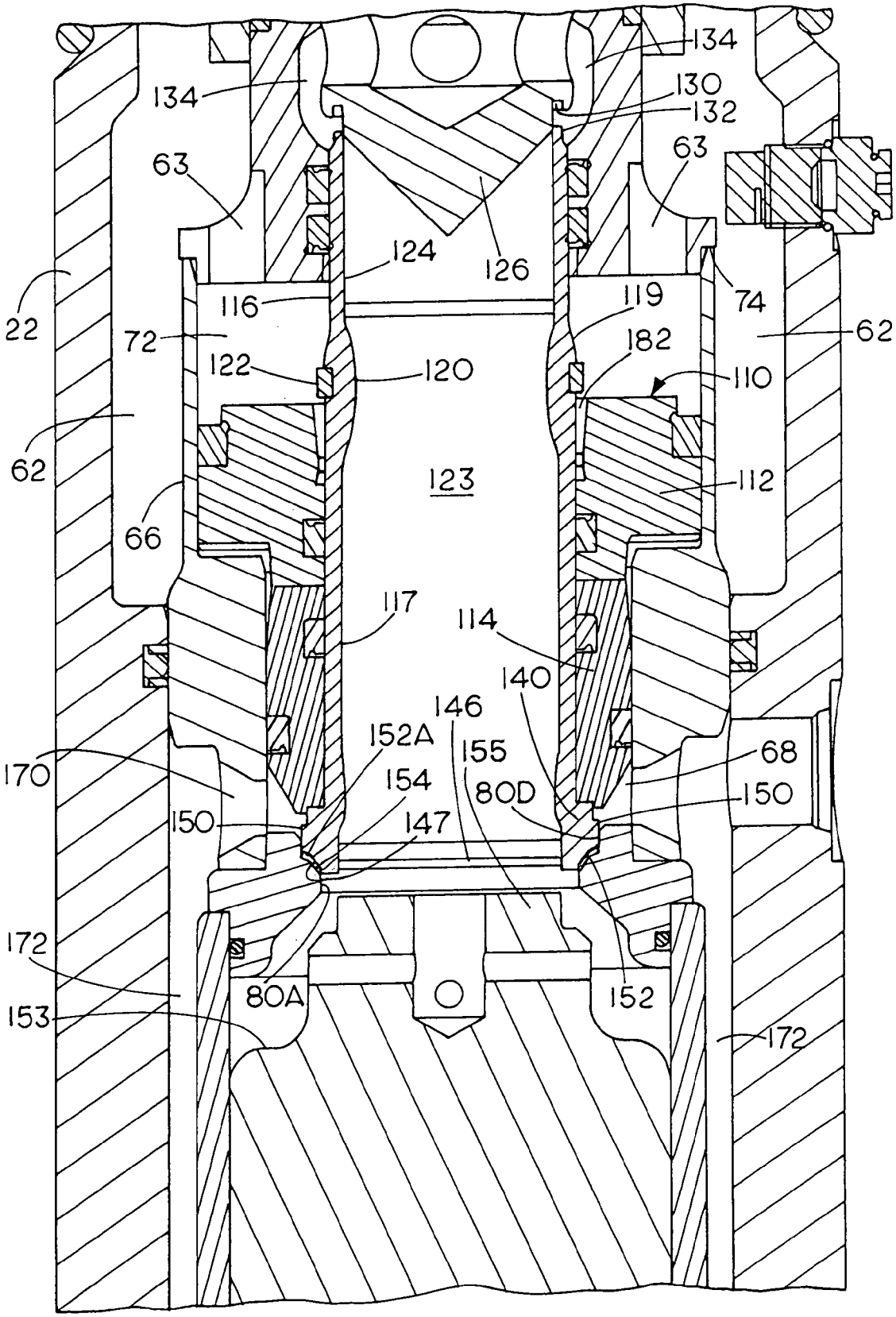
FIG. 8 is an enlarged sectional view of the valve as it is in the process of seating to show the arrangement that provides hydraulic cushioning.
Figure 9:
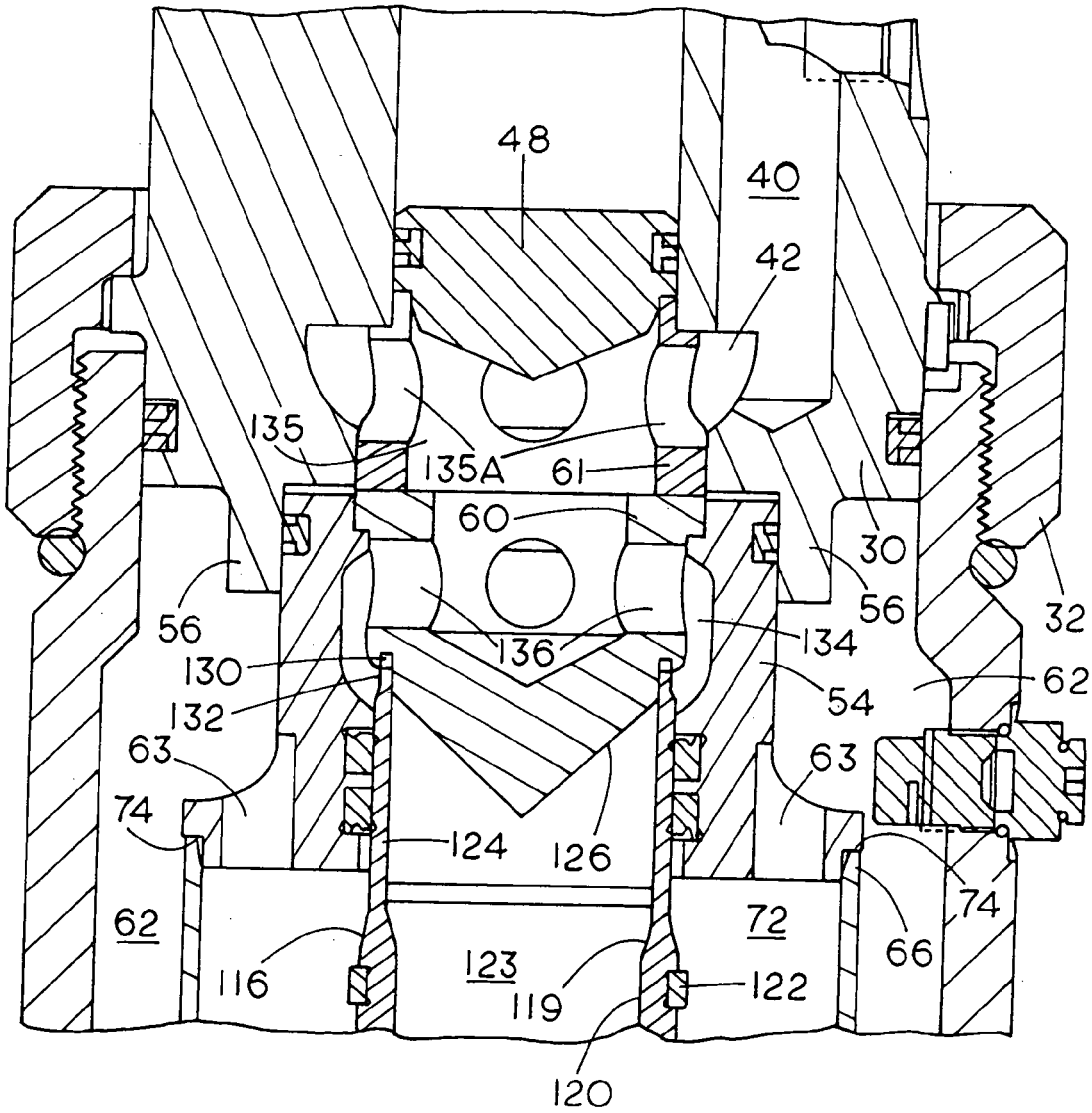
FIG. 9 is a sectional view of an upper end of the valve as it approaches its maximum upward movement into a cushioning groove where the valve stops.

The plug end 126 has a tapered surface inside the sleeve valve 116 and also has an annular valve seal groove 130 formed in a shoulder on plug 60 that will receive a suitably shaped end portion 132 of the sleeve valve 116, when the sleeve valve is moved upwardly toward that groove 130 to close the drain. The end portion 132 is shown to be smaller size than the guide forming end portion 124 of the sleeve valve 116. A tapered surface 133 (FIGS. 7, 8 and 9) guides the drain valve end portion 132 of the sleeve valve 116.

Figure 6:
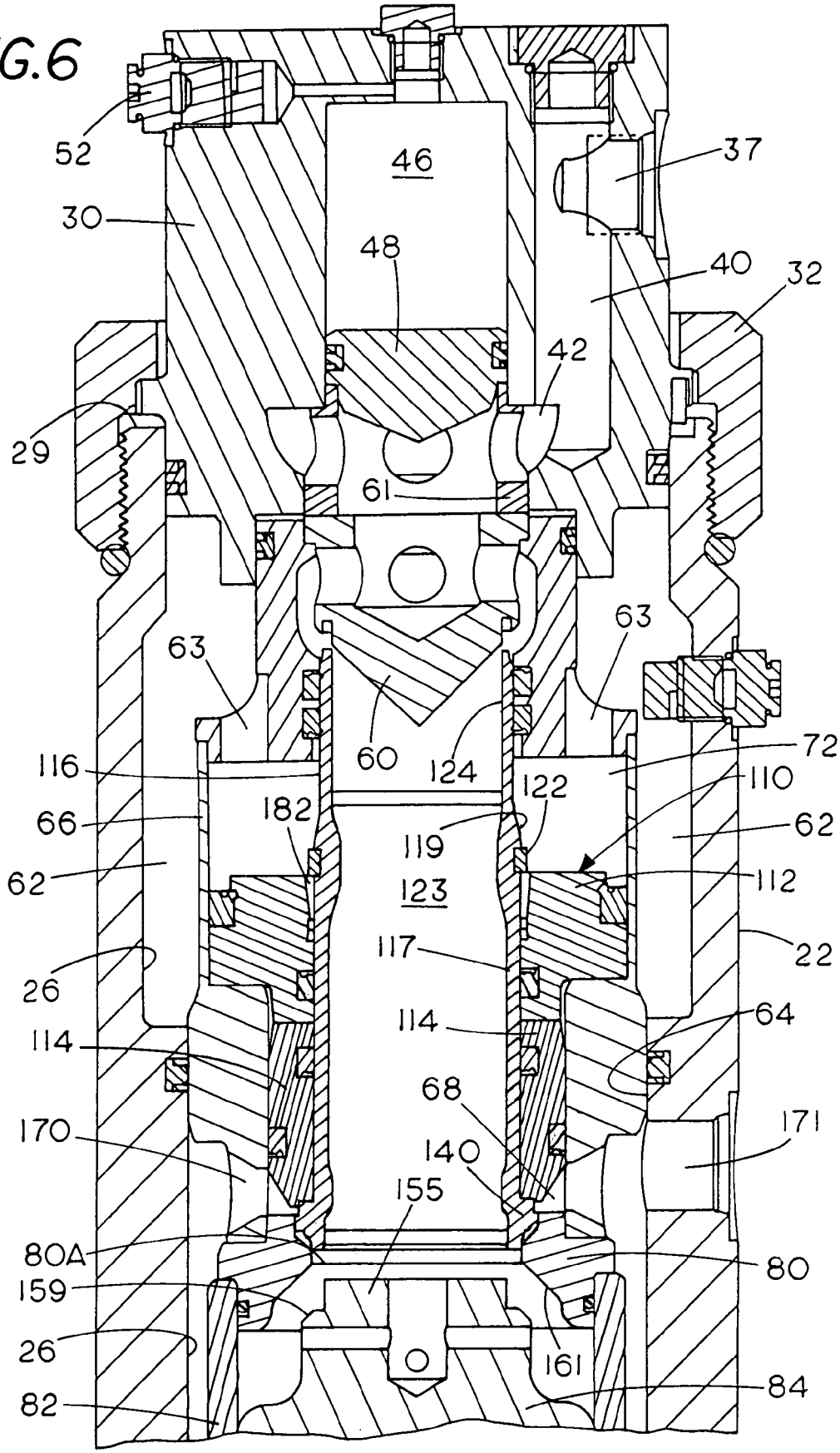
FIG. 6 is an enlarged cross sectional view of the end of the valve as it seats and also as an upper end is open a passageway to drain.

The plug 60 is of smaller diameter than the interior bore of the valve guide 54, and an annular passageway 134 is formed around the plug 60. The plug 60 also has cross passageways 136 that open to annular passageway 134, and to a central upwardly open bore in plug 60 so that when the valve is in the "start" position of FIGS. 2 and 6 and retracted away from groove 130, oil on the interior of the valve sleeve 116 can flow past the tapered plug end 126 through passageway 134, cross bores 136 out the bore in plug 60, and into a chamber 135 of sleeve 61. The chamber 135 has cross bores 135A open to the chamber 42 and to the drain passageway 40. Chamber 135 is also open to the lower end of accumulator piston 48 opposite from the fluid under pressure in chamber 46.

The accumulator piston 48 slides in the pressurized chamber 46 of the end cap 30. The oil in the passageways 136 and chamber 135 will act against the lower end of the accumulator piston 48, and when the pressure spikes sufficiently, the accumulator piston will be forced upwardly to dampen such spikes. Normal flow to the drain goes out passageway 40 in the end cap 30, and then out through port 37.

The lower portion 117 of the sleeve valve 116 slides in the interior bore of the piston portion 114, and as can be seen in FIGS. 2, 3, 7 and 8, the lower end of the sleeve valve 116 has an enlarged seal ring 140 that forms an upwardly facing shoulder 142 that is engaged by a mating shoulder on the lower end 144 of the lower piston portion 114. The seal ring 140 on the sleeve valve has an end surface that is machined to form a narrow end ring 146 (FIGS. 7 and 8) that is on a first or upper side of orifice ring 80 and which fits inside the orifice ring. The end surface of the seal ring 140 has a cylindrical surface 150 that is outwardly from the exterior surface of ring 146. There is a conical or tapered sealing surface 152 (see FIG. 12) on the outer periphery of the narrow ring 146 of the sleeve valve 116. The sealing surface 152 is made to seal against an inner corner of an internal seat seal surface section 154 on the upper side of the orifice ring 80, where it joins a cylindrical surface 80A. The upper surface of the orifice ring closes the lower end of a chamber 68 under piston section 114.

The configuration of the valve seat on orifice ring 80 for valve 116 and the stepped surfaces on the end of valve ring 142 provides for a cushioning effect as sleeve valve 116 closes the orifice opening and seals the orifice ring.

Figure 3:
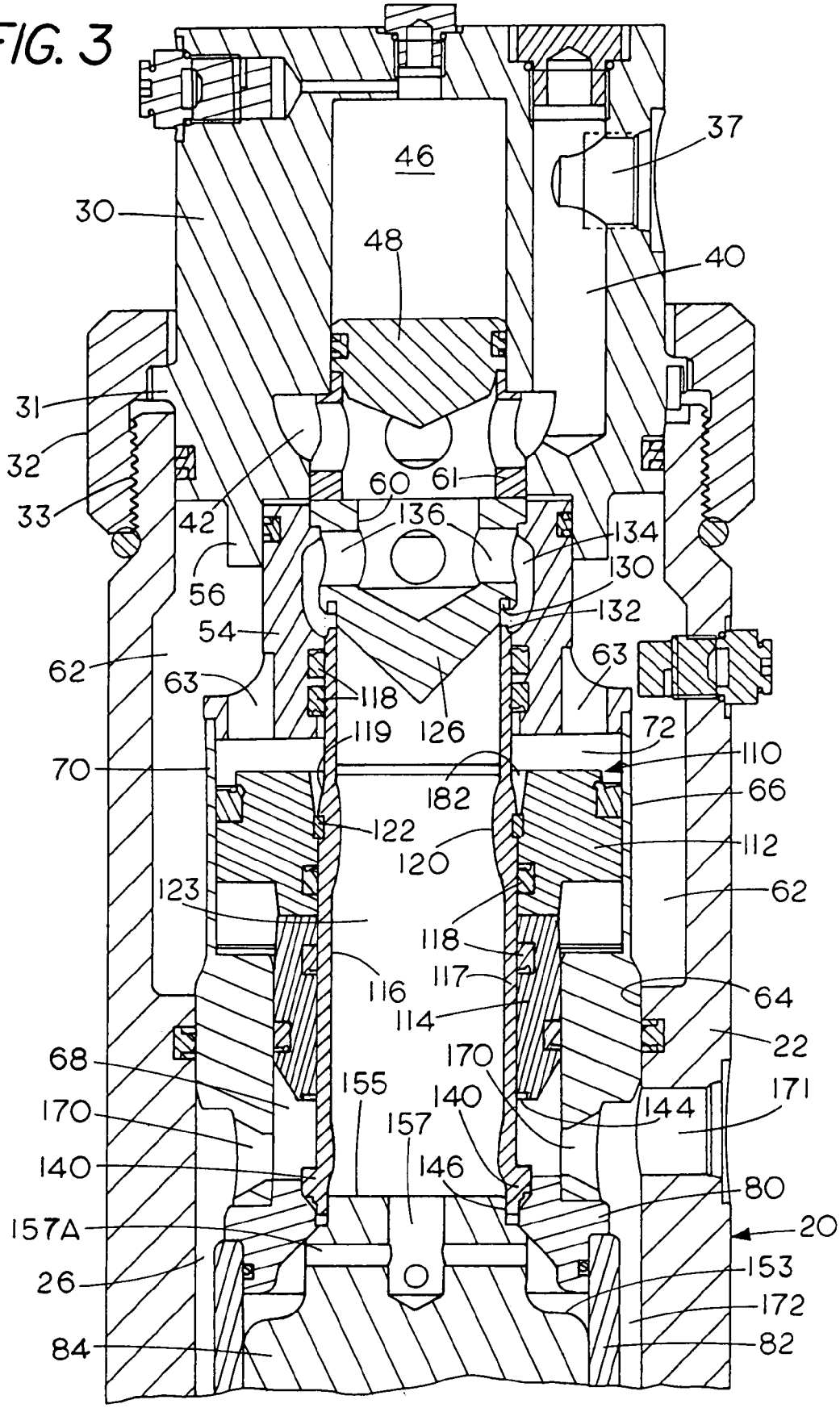
FIG. 3 is an enlarged cross sectional view of the valve lower portion and piston after the start of an impact cycle.

The upper end 155 of the hammer 84 forms a reduced diameter boss that fits inside the ring 146 of end portion 117 of the sleeve valve 116, when the sleeve valve 116 is seated on the orifice ring 80 and the hammer 84 has returned to its raised or upper position shown in FIGS. 1A, 2 and 3, which is the start position for an operating cycle. A hydraulic pressure fitting or port 171 is provided in the body 22. Also ports 170 open through the piston sleeve lower section adjacent and above the orifice ring 80, as can be seen. The ports 170 open to chamber 168 under the piston section 114. Fluid under pressure from a source or pump 178 and valve 177 that are connected to port 171, when the impact tool is to be started is thus present in the annular passageway 172 that surrounds the hammer bearing sleeve 82 above the spacer 86 and above the lower bearing 88 which is sealed on the interior surface of the body 22.

The spacer 86 has passageways or ports 176 therein (FIG. 1A), so that fluid under pressure from the inlet port 171 is provided through the annular passageway 172, and through the ports 176 and the pressure will act on the shoulder 90 of the hammer to force the hammer against orifice ring 80. The shoulder 90 faces toward the sealed lower bearing 88 and the breaking tool. The sealed lower bearing 88 provides a reaction surface for pressure since the bearing 88 is sealed on the interior bore of the housing 22. The operating hydraulic fluid under pressure is maintained from a pump 178 through a valve 177. Pump 178 is connected to a hydraulic fluid tank 180. The tank 180 receives the drain fluid from a line connected to the drain port 37.

Fluid under pressure is present in the chamber 172, when the sleeve valve 116 is closed and hydraulic valve 177 is open or on. The piston 110 is then in its position shown in FIG. 2. The piston 110, comprising the large diameter piston portion 112 and the smaller diameter piston portion 114 has been pushed to this position by the gas pressure in the piston chamber 72 the compressed gas chamber 62. Valve sleeve 116 will be seated and sealed on the second or upper side of orifice ring 80, and thus because of the selected length of the sleeve valve, the drain passageway from the interior of the sleeve valve 116 out through passageways 136 in plug 60 will be open. The fit around the tapered end 126 is not a sealing fit, so oil can drain out past the end plug 60 and into the chamber 42 and out through the drain fitting 37.

The hydraulic fluid under pressure that is present at the port 171 will force hammer 84 up against the orifice ring and the pressure at ports 170 will act on the bottom side of the small diameter piston portion 114, through a pair or more of ports 169 in the lower end of sleeve 66. This fluid under pressure then will cause the piston 110 to start to move upwardly, The piston 110 moves to position shown in FIG. 3, where the ring 122 on sleeve valve 116 will slide into a groove 182 in the piston section 112. The ring 122 will be held in place, and an offset or shoulder in groove 182 will be positioned to drive the ring or drive element 122 and the sleeve valve 116 upwardly. The sleeve valve 116 is held against the orifice ring 80 to close the orifice by gas pressure action on shoulder 119 while the piston 110 is moved to the position of FIG. 3. Hydraulic pressure on shoulder 144 also will hold valve 116 down.

The hydraulic fluid under pressure in chamber 172 and 89 forces the hammer upwardly to seal on a second or lower side of orifice seal ring 80, as long as the drain passage through the central or interior bore 123 of sleeve valve 116 is open to the drain.

Figure 4:
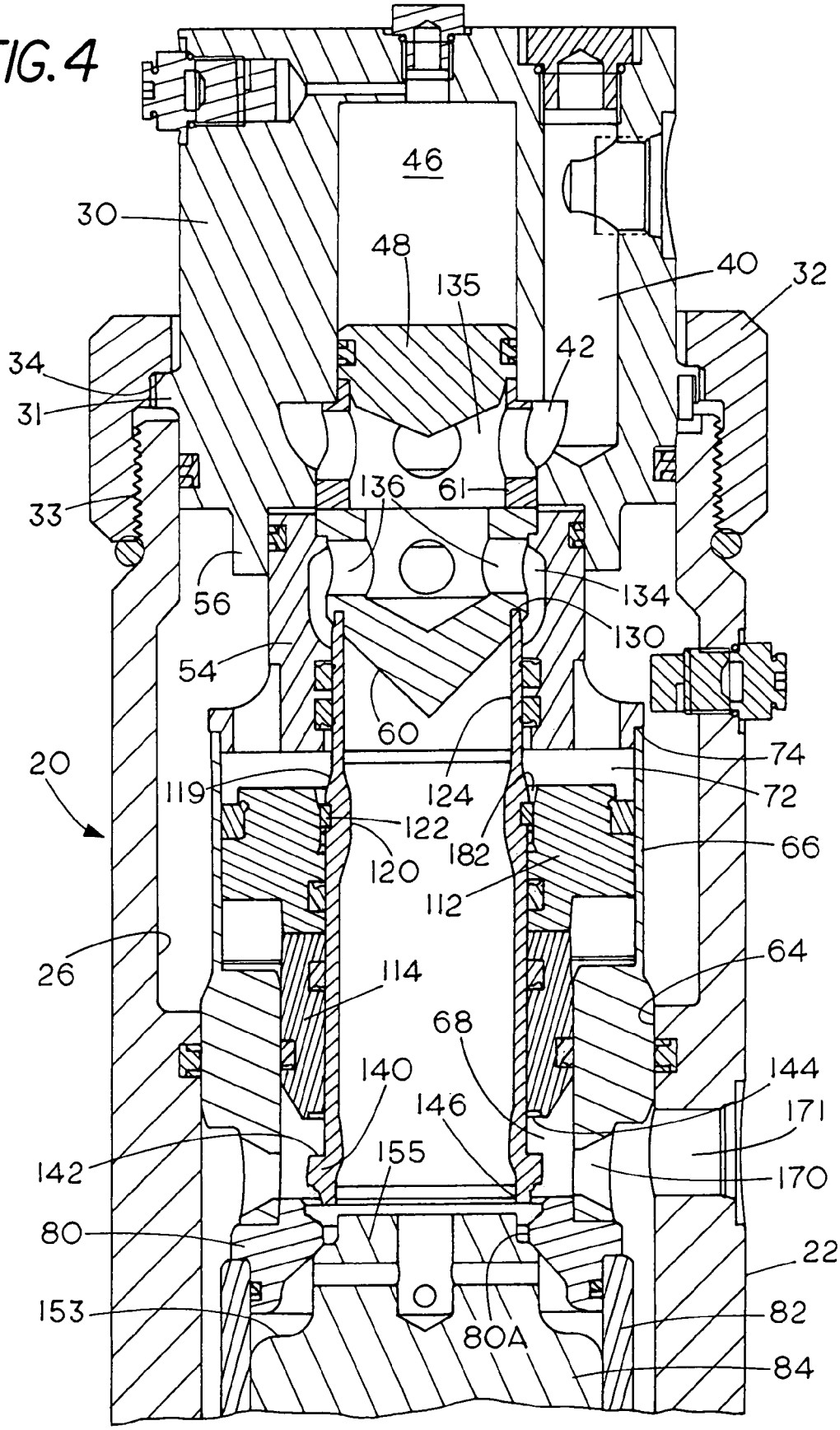
FIG. 4 is an enlarged cross sectional view of an upper end of the valve after the piston has completed a gas compression stroke.
Figure 5:
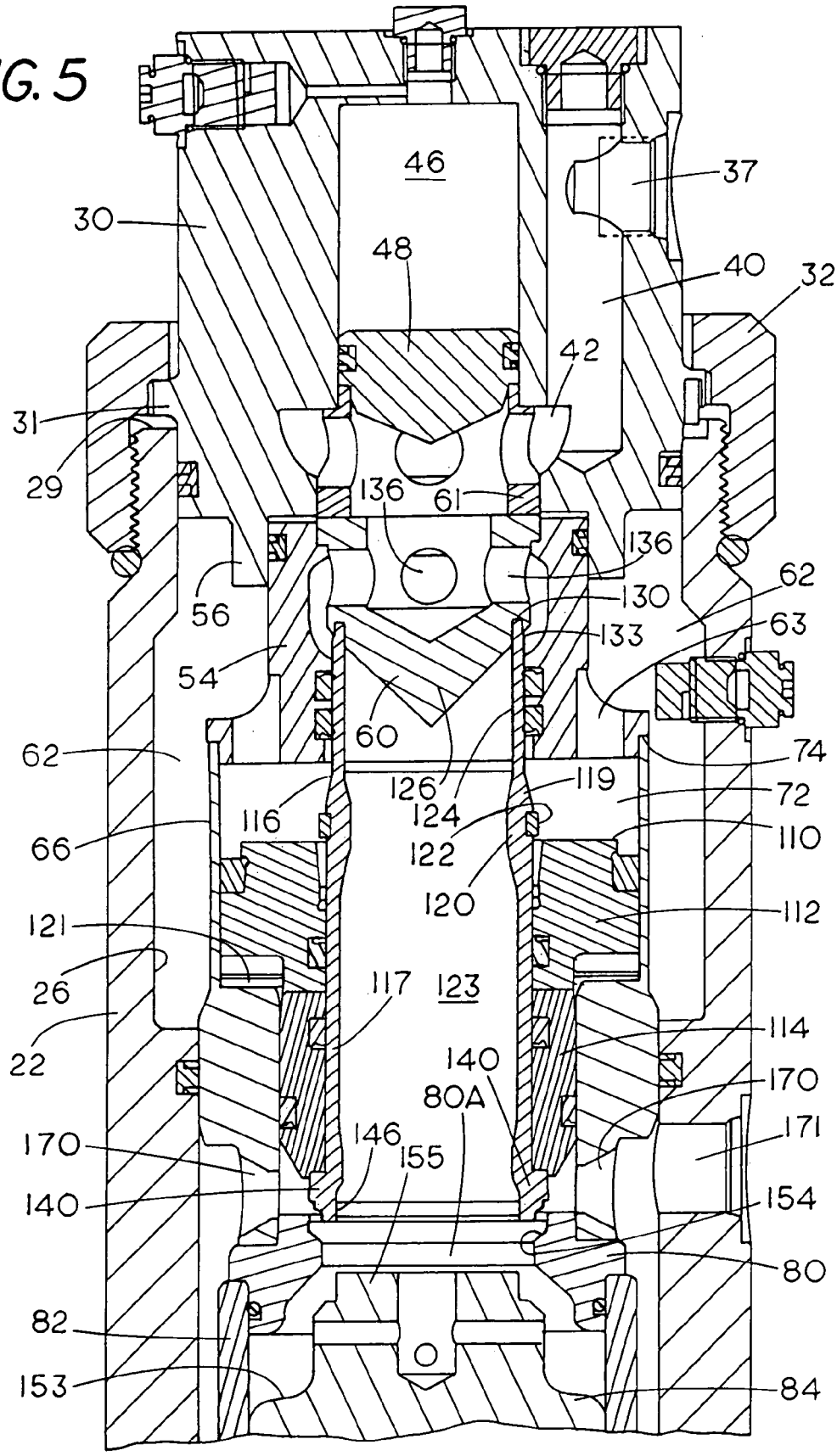
FIG. 5 is a view similar to FIG. 4 with the valve shown in its raised position and the piston engaging the valve during drive stroke.

At the same time, the gas in the piston chamber 72 and also in gas storage chamber 62 will be compressed to a higher level as the piston moves up. The chamber 62 communicates with the chamber 72 through passageways indicated at 63. As the sleeve valve 116 moves upwardly, the valving end 132 will start to seal around the upper portion of the end 126 of plug 60 and the end 132 moves to position shown in FIG. 9. The groove 130 has oil in it and the final upward movement squeezes the oil out of groove 130 to provide a cushioning effect for the sleeve valve. The end 132 enters the groove 130 and will be stopped in its upward position with the orifice seal open. In this upward position of the sleeve valve 116, as shown in FIG. 4, the drain passage from the interior of the sleeve valve 116 is shut off because of the fit between the interior bore of the sleeve valve 116 and the outer surface of the top part of tapered plug 126 as well as the fit of end 132 into the groove 130. The sleeve valve 116 is stopped from further upward movement in this position.

As the sleeve valve 116 is lifted by the piston 110, by driving through the ring 122, the lower seal ring 140 is raised into groove 130 by pressure under the ring 140, as it moves out of sealing relationship with the first side of orifice ring 80, opening a gap between the end ring 140 and the valve seat on the orifice bore of the first side of orifice ring 80. Opening the bore 80A of orifice 80 will open a passage for the hydraulic fluid piston in chamber 68 under the piston smaller diameter portion 114 to flow through the bore 80A. The pressure of the compressed gas on the large diameter piston portion 112 will force the piston to move or slam toward the orifice ring 80 and the hydraulic fluid under the piston in chamber 168 acts upon the top of the hammer 84. Hydraulic fluid will open valve 116 after seal is broken.

The compressed gas in chambers 62 and 72 will accelerate the piston 110 at a high rate, so that the hydraulic fluid trapped under the piston in chamber 168, which initially lifted the piston, will be accelerated through the bore 80A of orifice ring 80 against the top of the hammer 84 in a chamber formed by sleeve 82. Once the orifice opening cracks, the boss 155 of the hammer 84 receives the pressure and the pressure acts through bore 157 and 157A and the hammer 84 is accelerated away from the sleeve valve 116 and the orifice ring 80 to strike the impact tool 98 with a sharp blow. The full area of the hammer, including the shoulder 153 surrounds the end 152 and fluid from the piston acts on the entire area. The hammer upper portion 155 is surrounded by a conical surface 159 that seats and seals on a seal surface 161 on the second side of orifice ring 80, and as soon as that seal formed by sleeve valve 116 cracks open, there is a rapid (instantaneous) movement of the hammer 84 away from the orifice ring 80.

The shoulder at the lower end of the smaller diameter piston portion 114 then engages the ring 140 on the sleeve valve 116 as the piston is moving down, and the sleeve valve will commence moving down by gas pressure on shoulder 119. The sleeve valve is also forced downwardly toward the orifice ring 80 by piston section 114 to cause the seal on the lower side of the valve ring 140 to close off the orifice ring 80 passageway or bore 80A. The passageway to drain through the interior of sleeve valve 116 is then open.

When the hammer 84 hits the breaking or striking tool 98, the hammer rebounds rapidly upwardly, causing a pressure spike in the hydraulic fluid that is above the hammer end 155 and inside the sleeve valve 116. The pressure spike is transmitted through the interior bore 123 of the sleeve valve 116, and because the sleeve valve has been moved down to the position closing the first side edge orifice ring, the interior bore 123 of the sleeve valve is open to the hammer chamber and also to the drain through passageways 134, and 37. The pressure spike will act on the accumulator piston 48, and the piston 48 can move against the gas pressure in chamber 46 and will absorb or modulate the pressure spike. The accumulator piston 48 minimizes the likelihood of damage to components of the hammer caused by such pressure spikes.

The piston 110 is made into two sections 112 and 114, as stated, so as the piston moves to drive the hammer head under the gas pressure, the larger diameter piston portion 112 will engage a shoulder 121 formed by the section 66 of the piston sleeve, and the cylindrical portion 114 can separate and the inertia in direction toward orifice ring 80 is reduced. The inertia of the piston portion 114 that has to be stopped at the end of the drive stroke, while the piston is moving under the influence of the high pressure gas is minimized, and thus wear and pounding of the sleeve valve 116 against the orifice ring 80 is reduced. The piston portion 112 is stopped independently on the shoulder 121.

Figure 12:
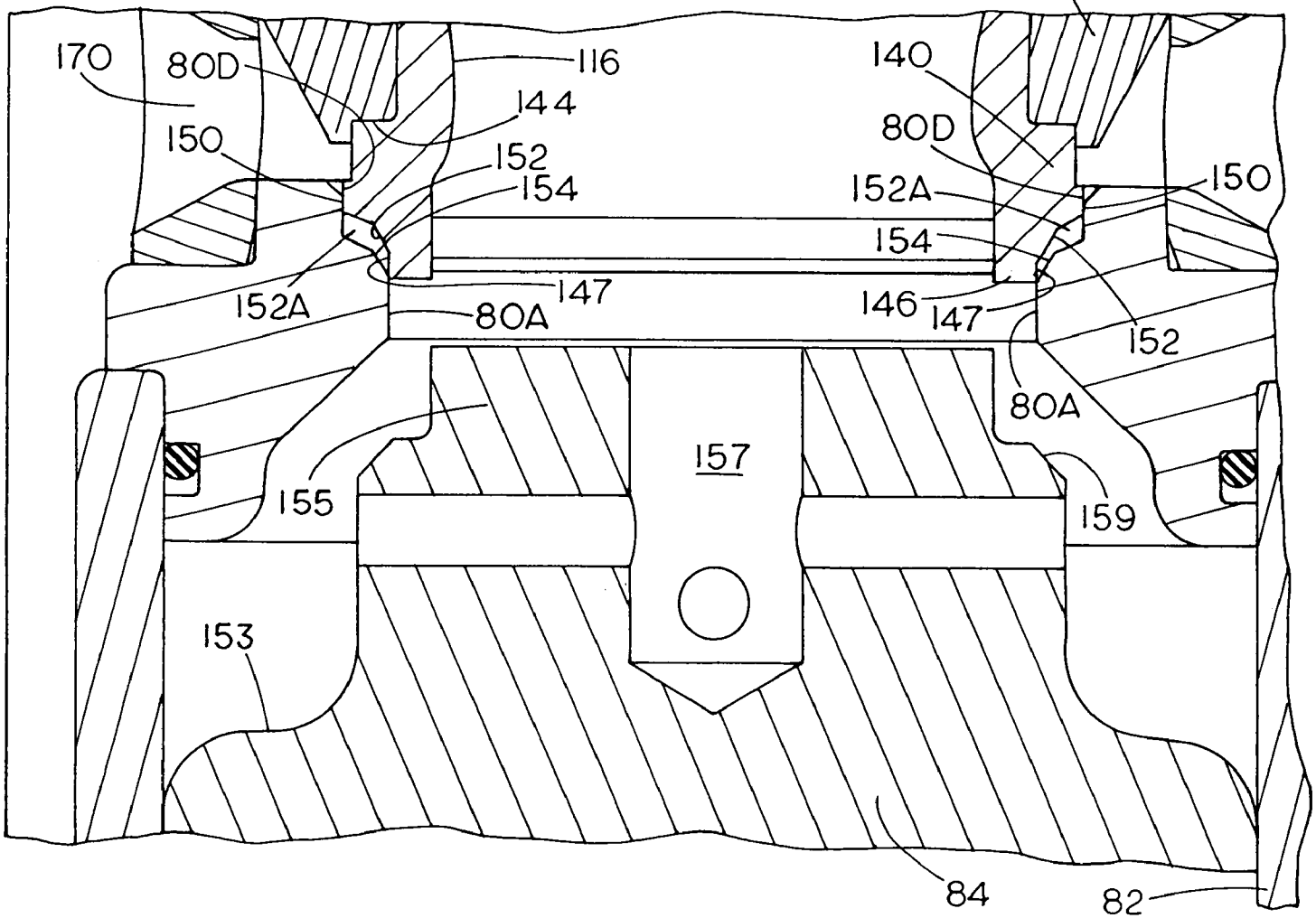
FIG. 12 is an enlarged fragmentary cross sectional view of the lower end of a valve and orifice ring shown in FIG. 8.

The lower end ring 146 of the seal ring 140 on sleeve valve 116 has an outer cylindrical surface 147 that sealingly fits inside the diameter of the center opening surface 80A of orifice ring 80. A larger diameter cylindrical surface 150 on the seal ring 140 (FIGS. 8 and 12) also slides inside a larger diameter internal cylindrical surface 80D on orifice ring 80. The surfaces 80A and 80D are joined by a surface, including the seal surface section 154. The seal surface 152 on the valve 116 seal ring 140 is spaced from seal surface section 154 when the surfaces 150 and 147 are first engaging surfaces 80D and 80A (FIG. 12). This means that there will be some oil trapped in the space shown in FIG. 12 at 152A between the seal surface section 154 of orifice ring 80 and the valve 116 seal surface 152 of end ring 146. As the sleeve valve 116 fully closes the orifice bore, as surface 152 engages the corner of surface 154 and surface 80A formed on orifice ring 80, the trapped oil in space 152A will be squeezed out past the outer cylindrical surfaces of the ring 146, and this cushions the sleeve valve 116 from slamming into position and damaging the valve seat 154 of orifice ring 80 and seal surface 152. Sealing the orifice also means that the input pressure acts to slow the piston and start to move it upwardly.

Figure 10:
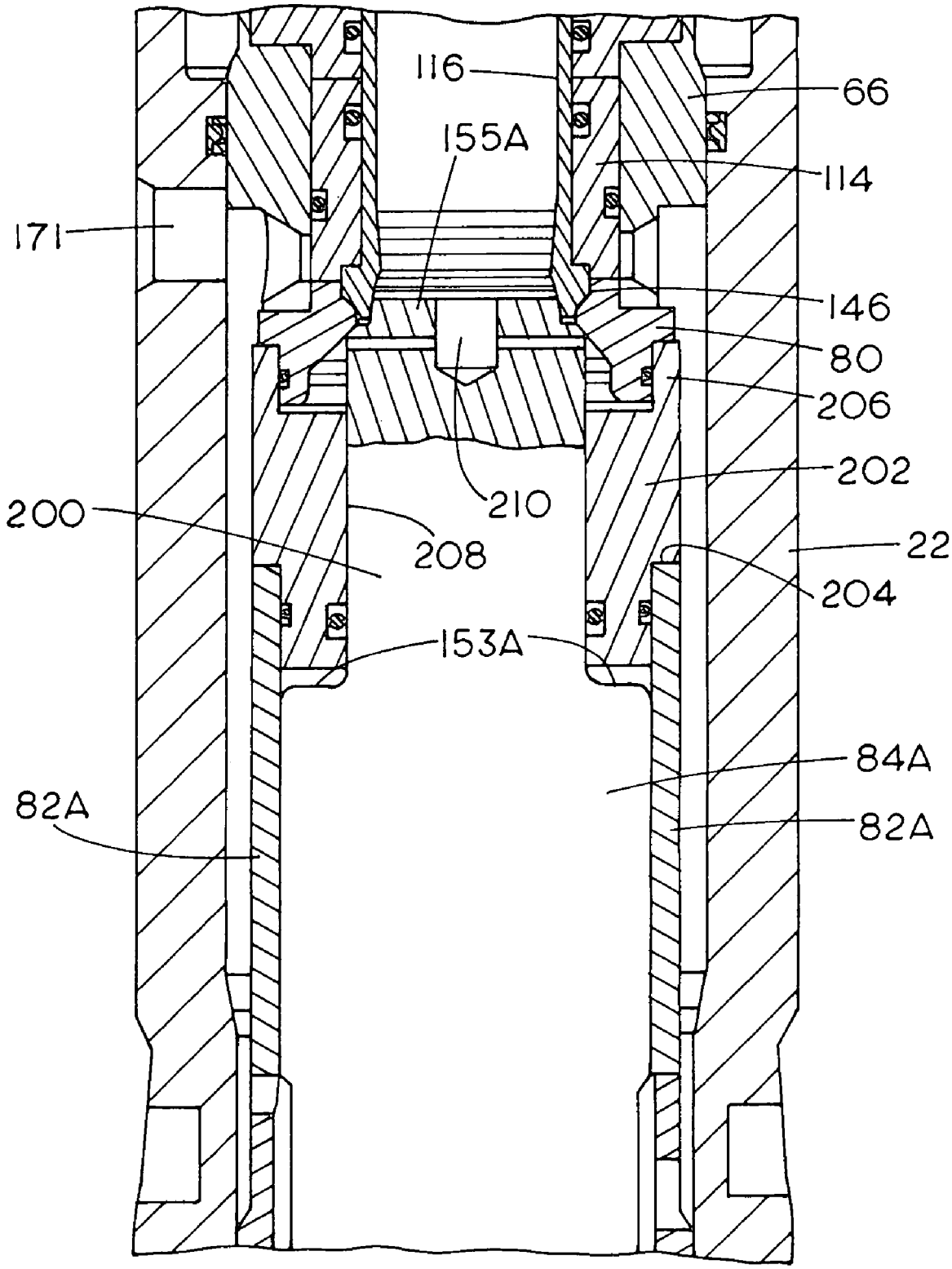
FIG. 10 is a fragmentary sectional view similar to FIG. 1A showing a modified hammer with an elongated upper end.

In FIG. 10, a modified form of the hammer, which has an elongated upper portion that fits into the internal end of the sleeve valve 116, and in particular, that slides into the end portion or ring 146 of the sleeve valve 116.

The only portions that are changed in FIG. 10 relate to the hammer, and the guide on mounting for the upper end of the hammer, and the other parts are numbered the same as previously shown. The operation of the hammer and the entire impact tool remains the same.

In FIG. 10, the hammer shown at 84A has an elongated upper end portion 200, and has a narrower upper end 155A that corresponds with the upper end 155 and fits within the ring 146 of the sleeve valve 116. The sleeve valve slidably fits within the piston sections 112 and 114 as previously explained, and the orifice ring 80 has the same construction as before. However, the sleeve bearing 82A that is shown in FIG. 10 and which corresponds to the sleeve bearing 82 in the previous form of the invention, is not as long in axial direction, it slidably supports the center section of the hammer 84A as previously explained. At the upper end of sleeve bearing 82A, a guide sleeve 202 is placed, and it has a shoulder 204 that is supported on the end of sleeve bearing 82A. The lower end of sleeve bearing 82A is supported as previously explained in relation to sleeve bearing 82. The guide sleeve 202 has a narrow upper rim portion 206 that supports the orifice ring 80, and the inside diameter 208 of the guide sleeve 202 slidably supports and guides the elongated upper portion 200 of the hammer as it reciprocates as previously explained. The ports shown at 210 provide for discharging oil to act on the upper end of the hammer to cushion the hammer impact on the lower side of orifice ring 80 on the hammer up stroke when the valve opens.

In FIG. 10, the inlet port 171 is on the opposite side of the main outer housing 22, but the construction is the same as before, and operation is the same as in the previous form of the invention.

Figure 11:
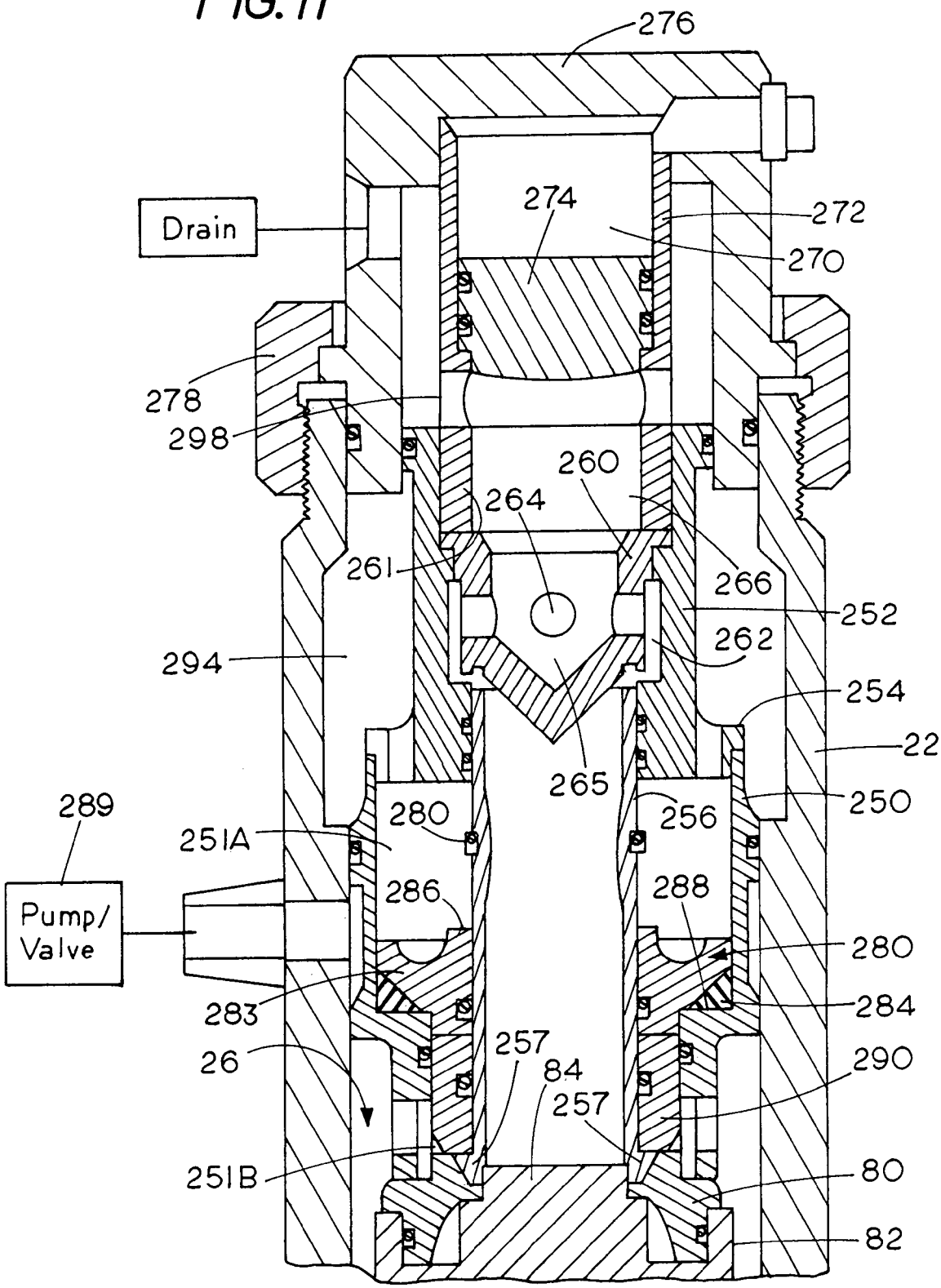
FIG. 11 is a fragmentary sectional view of an upper end of the impact tool of the present invention similar to FIG. 2, and showing a further preferred embodiment for the instruction.

In FIG. 11, a modified drain and impact absorbing accumulator construction is shown, as well as a slightly changed configuration for the two part piston. In FIG. 11, the outer body or housing 22 is substantially the same as shown before, as is the mounting for the orifice ring 80, the hammer 84 and the lower sections of the impact tool. They are numbered in the same manner. The body 22 has an interior bore, and the hammer bearing 82 that supports the orifice ring 80 is shown only fragmentarily. The hammer 84 is shown in position on the lower side of the orifice ring 80.

A piston sleeve 250 is essentially the same construction as the piston sleeve 66, but has a slightly different outer configuration and is sealed against an inner surface of the body 22, that defines the central longitudinal chamber 26. The first end of piston sleeve 250, in this form of the invention, rests on the upper surface of the orifice ring 80 and a second end of the piston sleeve supports a valve guide sleeve 252 at a shoulder portion 254 of the valve guide sleeve. The valve guide sleeve 252 guides an upper end portion of a tubular sleeve valve 256, which operates in the same manner as the tubular sleeve valve 116 in the first form of the invention. The sleeve valve 256 is slightly modified in construction, as will be more fully explained.

The valve guide sleeve 252 supports a drain valve body or block 260 on an internal shoulder. The drain valve body 260 is on the interior bore of the guide sleeve and closes the interior bore of the valve guide sleeve. The body or block 260 has a lower surface that acts as a valve and is closed and opened for draining by the sleeve valve 256, as the unit operates, in the same manner as previously explained.

A drain passage 262 is formed around the drain valve body 260, and suitable openings 264 are provided to a center bore 265 of the drain valve body 260. The center bore 265 is open to a drain chamber 266 formed in the upper end of the valve guide sleeve 252, which in turn is open through channels to a lower end of a preconfigured bore or chamber 270 in an accumulator tube or sleeve 272 and urged against stops by gas pressure in bore 270. An accumulator piston 274 is mounted in the bore of the accumulator sleeve 272. The sleeve 272 is held in place with a cap 276. The cap 276 fits inside the interior bore 26 of the body 22 at an upper end, and a nut 278 clamps the end cap 276 in position against a shoulder surface to close the end of the body, as previously explained. The drain valve body 260 is held in place with a spacer sleeve 261 that is held by accumulator sleeve 272.

The two section piston 282, includes an upper or first section 284 that has an upper surface ring type portion 286 that will engage a snap ring or drive element 280 around the tubular sleeve valve 256 for lifting the sleeve valve during operation when the piston assembly 280 is moved upwardly in the piston sleeve.

The piston sleeve 250 is formed with two different diameters, with the upper or first piston chamber 251A larger than a lower or second piston chamber 251B. The upper or first piston section 283 is in first chamber 251A and has a resilient pad or steel spring 284 that is on a shoulder 288 in piston sleeve 250 to cushion the piston on the downstroke. A second piston section 290 slides within the reduced diameter bore of the piston sleeve forming piston chamber 251B. The two portions of the piston are separated, for the purposes previously explained. A slightly different configuration of the upper piston section is used to move sleeve valve 256 upwardly.

The hydraulic pump or pressure source and valve 259 is provided to an inlet that provides hydraulic oil under pressure to piston chamber 251B. The piston will be forced upwardly to compress gas in piston chamber 251A and in a chamber 294, which is open to piston chamber 251A. The operation is the same as explained before, with the drain path being slightly revised, utilizing a sleeve 272 for the accumulator piston 274, rather than having the accumulator piston mounted directly in a bore on the end cap.

The accumulator piston 274 will act against gas pressure to reduce shock loads as the drain opens, as previously explained. When the upper end of the tubular sleeve valve 256 is moved away from the drain valve body 260, the hydraulic oil on the interior of the sleeve valve will be forced out through the drain passageways shown.

It can be seen that the accumulator sleeve 272 has drain passageways 298 leading to the main drain channel in the cap 276. These drain passageways 298 can be any size or configuration. The accumulator piston 274 is open to receive any pressure impulses that are caused by the pressure spikes from hammer rebound or other causes to absorb shock loads.

Again, the upper end portion 200 of the hammer may be elongated for providing a longer stroke, if desired. The action of providing an oil cushion to reduce wear or pounding on both ends of the tubular sleeve valve also remains the same. The annular channel shaped drain valve seat on valve block 260 receives the end of sleeve valve 256 and oil squeezes out to provide a cushion. Also, the orifice ring 80 and lower end of sleeve valve 256 are shaped to provide a trapped oil cushion.

In operation, the piston 280 will be raised to compress gas in the first piston chamber 251A and in gas chamber 294 and as the piston moves up, it engages drive element 280, lifting the tubular sleeve valve so the first end closes the drain opening and the second end lifts from orifice ring 80. This opens the orifice seal and hydraulic fluid flows through the orifice opening to drive the hammer as the gas forces the piston toward the orifice ring 80. The end of second piston section 290 then bears on the top shoulder of a seal ring 257 on sleeve valve 256 to force the sleeve valve onto the orifice ring to form the orifice seal, and the drain is also opened.

The large pressurized gas chamber 62 or 294 provides for a larger gas volume for driving the piston on the drive stroke, so there is less change in pressure during the hammer driving cycle. A higher average pressure is available to act on the piston to drive the hammer 84 against the impact or breaking tool 98. The two-part piston 110 or 280 reduces the inertia as it stops after driving the hammer 84 because it will separate as it decelerates, and mass of the piston that pounds the valve is thus reduced.

The nitrogen gas in the chamber 62 or 294 is kept in a desired level before compression. During the compression of the gas in the chamber 62 or 294 by the respective piston, the gas pressure rises. Hydraulic pressures for driving the piston can be selected from conventional pump sources. The hammer can be made to cycle in the range of several hundred cycles per minute.

The present impact tool includes the features of having a large gas volume that is compressed when the piston is on its compression stroke. This means there is less change in the pressure during the cycle and a higher average pressure for driving the piston and in turn, urging the hydraulic oil to move the hammer rapidly. The sleeve valve arrangement is made so that the movement upwardly is stopped at a known position against the drain valve seat, and in this way, the opening at the lower or orifice seal end of the valve adjacent the orifice ring can be controlled and restricted so that the oil that is needed from the piston chamber to drive the hammer is reduced in volume.

A larger cushioning area for the returning of the valve when it seats on the orifice ring is helpful in reducing the wear and shock loading of the valve.

The piston has a large area for the gas pressure with the two stage piston being used, that requires less pressure on the piston to accelerate the oil in the lower chamber under the smaller piston section against the hammer.

The two piece piston lower part decelerates separately from the upper part, so that there is less inertia and pounding of the lower end of the sleeve valve as the piston closes the valve on the orifice ring. Since the first, larger section of the piston rests on a separate shoulder in the respective piston sleeve, the inertial force from the larger piston section is reacted in the piston sleeve, rather than on the lower ends of the respective tubular sleeve valves.

If desired an elastomeric spring or ring, or a steel spring can be used above shoulder 121 or 288, as shown at 284 to cushion the piston, particularly if the piston is made in one piece. The lower end of piston section 114 can have a recess in it to and in trapping some oil as the piston section contacts the shoulder 142 on the piston sleeve, to cause a cushioning effect as well. The two diameters of the piston can be varied in ratio and permit increasing the frequency using the same amount of hydraulic oil under pressure. Also one can lower the gas pressure and displace more gas with the same amount of hydraulic oil.

Changing the stroke of the piston before it lifts the tubular sleeve valve upwardly will change the energy stored in the gas and will vary the frequency of the tool for a given oil flow.

Although the present invention has been described with reference to preferred embodiments, workers skilled in the art will recognize that changes may be made in form and detail without departing from the spirit and scope of the invention.

What is claimed is:

1. An impact tool comprising:

a body having a longitudinal axis, a central longitudinal passageway defined by an inner surface of the body, a striking end and a closed end;

an annular orifice ring in the central longitudinal passageway, the orifice ring being positioned in mid-portions of the central longitudinal passageway and having a center opening;

a tubular valve having an outer wall spaced from the inner surface of the body to form an annular passageway, said tubular valve having a center bore and a first end that forms an orifice seal around the center opening on a first side of the orifice;

a piston sealably fitted around the tubular valve, and within the annular passageway on the first side of the orifice ring, the orifice ring closing one end of the annular passageway;

a piston sleeve in which the piston is mounted, said piston sleeve being mounted inside the central longitudinal passageway and spaced from the inner surface of the body to form an annular gas chamber surrounding the piston sleeve, and a piston chamber surrounding the tubular valve;

a block closing the central longitudinal passage at the closed end of the body, said block having a central bore in which a second end portion of the tubular valve slides, and an annular valve seat at the closed end, the tubular valve having a length so a second end of the tubular valve is moved away from the annular valve seat to open the center bore of the tubular valve to an exhaust port when the first end of the tubular valve is engaging the orifice ring; and a flow opening from a first end portion of the piston chamber of the piston sleeve to the annular gas chamber, whereby movement of a first end of the piston toward the block under hydraulic pressure in a second end portion of the piston chamber acting on a second opposite end of the piston compresses gas within the first end portion of the piston chamber and the annular gas chamber to provide a driving force on the first end of the piston when the hydraulic pressure on the second opposite end of the piston is relieved by the piston moving the first end of the tubular valve away from the orifice ring to open the orifice seal.

2. The impact tool of claim 1, wherein said tubular valve has a drive element engagable by the piston and is moved toward the annular valve seat by the piston to open the orifice seal after hydraulic pressure acts on the second opposite end of the piston to move the piston toward the block a selected distance.

3. The impact tool of claim 1, wherein said tubular valve has a member that is engaged by the piston after the piston has moved a selected distance toward the block to lift one end of the tubular valve away from the orifice ring to open the orifice seal and permit hydraulic fluid under pressure in the second end portion of the piston chamber to be forced through the orifice center opening as the compressed gas drives the piston away from the block and toward the open orifice seal.

4. The impact tool of claim 3, further comprising a hammer mounted in said central longitudinal passageway for slidable movement toward and away from the orifice ring and on an opposite side of the orifice ring from the tubular valve, the hammer sealing on a portion of the orifice ring to close the center opening from the opposite side of the orifice ring when the hammer is in a raised position, and the hammer being forced by hydraulic fluid away from the orifice ring when the piston is driven by gas pressure toward the open orifice seal.

5. The impact tool of claim 3, wherein the member on said tubular valve comprises a drive element extending outwardly from an outer surface of the tubular valve at a position to be engaged by the piston after the piston has traveled a selected distance toward the block from a start position.

6. The impact tool of claim 5, wherein said tubular valve has an annular wall defining the center bore, the annular wall having an increased wall thickness in the region of mounting of the drive element.

7. The impact tool of claim 6, wherein the tubular valve increases in outer diameter at a desired location adjacent to the drive element, and on a side of the drive element toward the block to provide a surface on which gas pressure in the first end portion of the piston chamber acts to tend to move the tubular valve toward the orifice ring.

8. The impact tool of claim 1, wherein the annular valve seat at the closed end of the housing for the tubular valve comprises an annular recess that contains hydraulic oil when the tubular valve moves away from the annular valve seat to engage the orifice ring, and wherein the hydraulic oil in the recess is squeezed out of the recess as the tubular valve seats in the annular recess.

9. The impact tool of claim 1, wherein the first end of the tubular valve has an annular exterior shoulder facing toward the second opposite end of the piston, and protruding into the second end portion of the piston chamber, and the shoulder being engaged by the second opposite end of the piston when the piston is driven by driving force of the gas pressure to move the first end of the tubular valve to engage the orifice ring to form the orifice seal.

10. An impact tool comprising a body having a central longitudinal passage, and having a striking end and a closed end;

a piston reciprocal in said central longitudinal passage, said piston having a first end and a second end, the first end of the piston being open to a compressed gas chamber formed in the central longitudinal passage;

a tubular valve in the central longitudinal passage, said tubular valve mounting the piston for sliding movement along the tubular valve, and the tubular valve being movable along the central longitudinal passage relative to the body;

an exhaust valve block mounted adjacent the closed end of the central longitudinal passage, and having a guide fitting within a center bore of the tubular valve, said block having a shoulder portion surrounding the guide and aligning with an end of the tubular valve, said shoulder portion comprising an annular groove into which an end portion of the tubular valve fits such that when the tubular valve moves toward the annular groove hydraulic fluid being exhausted from the interior bore of the tubular valve is squeezed from the annular groove to cushion movement of the tubular valve toward the shoulder portion.

11. The impact tool of claim 10, wherein said central longitudinal passage has a piston sleeve mounted therein, the piston sleeve being of larger diameter than the tubular valve and the piston sliding in the piston sleeve in a piston chamber between the piston sleeve and the tubular valve, said piston sleeve having first and second portions with the first portion being larger than the second portion and slidably mounting a first portion of the piston facing toward the valve block, a second separable portion of the piston being mounted in the second portion of the piston sleeve, and bearing against the first portion of the piston, the piston forming first and second piston chambers in the first and second portions of the piston sleeve, respectively, whereby hydraulic pressure introduced into the second piston chamber formed at an end of the second portion of the piston opposite from the first portion of the piston forces both portions of the piston toward the valve block.

12. The impact tool of claim 11, and a mechanical element on the tubular valve engaged by the first portion of the piston when the piston portions are moved by hydraulic pressure toward the valve block to move the tubular valve toward the valve block and the annular groove forming a seal.

13. The impact tool of claim 12, wherein the tubular valve has a second end extending outwardly beyond an end of the second portion of the piston opposite from the first portion of the piston, and a shoulder surface on the tubular valve that is engaged by the second portion of the piston when the piston portions are moved away from the valve block.

14. The impact tool of claim 13, wherein the first piston chamber is enclosed and filled with a compressible gas such that the gas is compressed when the piston portions are forced toward the valve block, the second end of the tubular valve opening a hydraulic fluid discharge valve when the piston has moved a selected amount toward the valve block to relieve hydraulic pressure in the second piston chamber.

15. The impact tool of claim 14, and a hammer slidably mounted in the central longitudinal passage of the body and open to the central hydraulic fluid discharge valve, whereby when the tubular valve is moved to seat in the annular groove of the valve block, the hydraulic fluid discharge valve is opened and compressed gas drives the piston to force hydraulic fluid in the second piston to drive against the sliding hammer.

16. The impact tool of claim 14, wherein the second end of the tubular valve seats on a surface of the annular orifice ring when the tubular valve is moved away from the valve block, and wherein a tubular valve outer surface section at the second end of the tubular valve fits within an annular opening of the orifice ring, and the second end of the tubular valve has an external, outwardly extending surface joining the outer surface section that seats on a surface of the orifice ring after the outer surface section forms a chamber with the orifice ring to trap fluid against the orifice ring to provide a cushion as outwardly extending surface of the tubular valve moves toward and engages the orifice ring.

17. The impact tool of claim 11, wherein said piston sleeve is spaced from an inner surface of the longitudinal passage, and forms a gas chamber open to the first portion of the piston sleeve.

* * * * *

UNITED STATES PATENT AND TRADEMARK OFFICE

CERTIFICATE OF CORRECTION

PATENT NO. : 7,156,190 B2
APPLICATION NO. : 11/014466
DATED : January 2, 2007
INVENTOR(S) : Jack B. Ottestad et al.

It is certified that error appears in the above-identified patent and that said Letters Patent is hereby corrected as shown below:

Title page, item 73, delete "Woodcliff, NJ (US)" and insert --Montvale, NJ (US)--.

Signed and Sealed this

Fourth Day of December, 2007

JON W. DUDAS
*Director of the United States Patent and Trademark Office*